US009260943B2

(12) United States Patent
Eriksson et al.

(10) Patent No.: US 9,260,943 B2
(45) Date of Patent: Feb. 16, 2016

(54) TOOL HEALTH EVALUATION SYSTEM AND METHODOLOGY

(71) Applicant: Schlumberger Technology Corporation, Sugar Land, TX (US)

(72) Inventors: Staffan Kari Eriksson, Göteborg (SE); Jan Stefan Morley, Houston, TX (US); Eimund Liland, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 27 days.

(21) Appl. No.: 14/061,717

(22) Filed: Oct. 23, 2013

(65) Prior Publication Data

US 2015/0107901 A1 Apr. 23, 2015

(51) Int. Cl.

| | |
|---|---|
| ***G06F 19/00*** | (2011.01) |
| ***E21B 41/00*** | (2006.01) |
| ***E21B 44/00*** | (2006.01) |
| ***E21B 47/12*** | (2012.01) |
| *E21B 47/00* | (2012.01) |

(52) U.S. Cl.

CPC ..... *E21B 41/00* (2013.01); *E21B 44/00* (2013.01); *E21B 47/12* (2013.01); *E21B 47/0007* (2013.01)

(58) Field of Classification Search

CPC ..... E21B 44/00; E21B 47/01; E21B 47/12; E21B 47/04; E21B 49/003; G05D 19/02

USPC ..... 700/12, 150, 175, 204; 702/6, 9, 34; 175/40, 42, 45, 46

See application file for complete search history.

(56) References Cited

U.S. PATENT DOCUMENTS

| | | | | |
|---|---|---|---|---|
| 5,774,420 | A * | 6/1998 | Heysse et al. | 367/83 |
| 6,206,108 | B1 | 3/2001 | Macdonald et al. | |
| 6,272,434 | B1 * | 8/2001 | Wisler et al. | 702/9 |
| 8,204,697 | B2 | 6/2012 | Garvey | |
| 8,528,637 | B2 * | 9/2013 | Cresswell et al. | 166/255.1 |
| 2003/0182014 | A1 * | 9/2003 | McDonnell et al. | 700/159 |
| 2005/0171627 | A1 * | 8/2005 | Funk et al. | 700/121 |
| 2005/0279532 | A1 | 12/2005 | Ballantyne et al. | |
| 2006/0089744 | A1 * | 4/2006 | Jalluri et al. | 700/174 |
| 2006/0101465 | A1 * | 5/2006 | Kato et al. | 718/100 |
| 2006/0212224 | A1 * | 9/2006 | Jogi et al. | 702/9 |
| 2008/0125981 | A1 * | 5/2008 | Steinke | 702/34 |
| 2009/0045973 | A1 * | 2/2009 | Rodney et al. | 340/853.2 |

(Continued)

OTHER PUBLICATIONS

International search report and written opinion for the equivalent PCT patent application No. PCT US2014/059800 issued on Jan. 22, 2015.

*Primary Examiner* — Darrin Dunn

(74) *Attorney, Agent, or Firm* — Chadwick A. Sullivan; Wesley Noah

(57) ABSTRACT

A technique facilitates evaluation of a tool, such as a drill tool. The technique comprises collecting tool data via a sensor on a given tool during use of that tool in a given operation, e.g. drilling operation. Additional data related to the tool is accumulated from a plurality of sources external to the tool. For example, data may be collected from both downhole sources and surface sources. Upon completion of the operation, the tool data is transmitted to the surface for processing on a processor system in combination with the data cumulated from sources external to the tool. The processing may be performed in real time as the tool data is received from downhole to enable a comprehensive diagnosis of tool health prior to retrieval of the tool to the surface.

14 Claims, 11 Drawing Sheets

(56) References Cited

U.S. PATENT DOCUMENTS

| | | | | |
|---|---|---|---|---|
| 2009/0114445 | A1 | 5/2009 | Dashevskiy | |
| 2009/0299654 | A1 | 12/2009 | Garvey et al. | |
| 2010/0042327 | A1* | 2/2010 | Garvey et al. | 702/11 |
| 2012/0324420 | A1* | 12/2012 | Collinson | 717/105 |
| 2013/0080372 | A1* | 3/2013 | Ho et al. | 706/50 |
| 2013/0176137 | A1* | 7/2013 | Kolpack et al. | 340/854.3 |
| 2014/0240140 | A1* | 8/2014 | Switzer et al. | 340/854.6 |
| 2014/0291023 | A1* | 10/2014 | Edbury et al. | 175/24 |

* cited by examiner

TOOL HEALTH EVALUATION SYSTEM AND METHODOLOGY

BACKGROUND

Drilling systems are employed for drilling wellbores into subterranean formations to retrieve hydrocarbon fluids, such as oil and natural gas. The drilling systems may comprise a drill string having a plurality of drill tools which may be used to carry out the drilling operation. For example, drill tools may be used to rotate a drill bit for drilling the wellbore. Drill tools also may be used for controlling the direction of drilling, for monitoring the drilling process, for supplying drilling fluid, and for a variety of other drilling related tasks. The drill string and drill tools may be used for successive drilling jobs, however difficulties arise in determining the health of a given drill tool, particularly while the given drill tool is downhole in a wellbore.

SUMMARY

In general, a system and methodology are provided for evaluating a tool, such as a drill tool. The technique comprises collecting tool data via a sensor on a given tool during use of that tool in an operation, e.g. a drilling operation. Additional data related to the tool is accumulated from a plurality of sources external to the tool. For example, data may be collected from both downhole sources and surface sources. Upon completion of the operation, the tool data is transmitted to the surface for processing on a processor system in combination with the data accumulated from sources external to the tool. The processing may be performed in real time as the tool data is received from downhole to enable a comprehensive diagnosis of tool health prior to retrieval of the tool to the surface.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
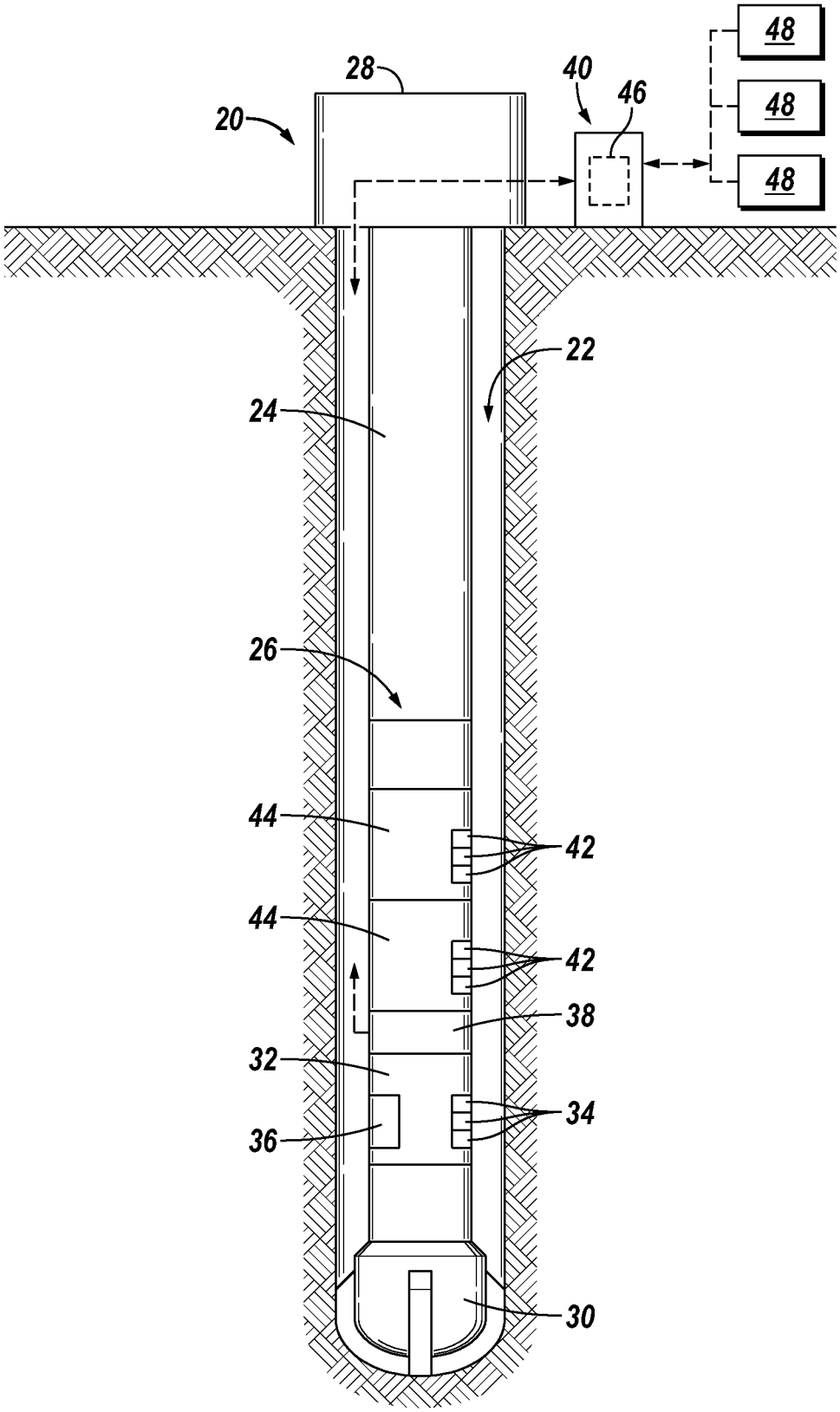
FIG. 1 is an illustration of an example of a well system having tool health diagnostic capability, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and methodology related to evaluation of tool health using a comprehensive analysis of available information. According to an embodiment, tool data is collected via a sensor on a given tool during use of that tool in a drilling operation or other operation. Additional data related to the tool is accumulated from a plurality of sources external to the tool, such as sensor data from other downhole sensors and data accumulated from a variety of databases, e.g. tool histories, tool engineering data, formation data, and/or other collected data. In this embodiment, the tool data is transmitted to the surface upon completion of the operation, e.g. drilling operation, for processing on a processor system in combination with the processing of data accumulated from sources external to the tool. The processing may be performed in real time as the tool data is received from downhole to enable a comprehensive diagnosis of tool health prior to retrieval of the tool to the surface.

According to an embodiment, tool related data may be aggregated over time and from diverse and derived sources. For example, tool health can be determined using accumulated information from many sources, thus enhancing decision-making capability with respect to tool health. Additionally, data gained from an operation, e.g. a drilling job, may be uploaded to a surface processing system for utilization in long-term trend analysis and to be fed into a subsequent tool run.

The system and methodology also may utilize health evaluation models, e.g. algorithmic engines, which are adaptable and programmable according to derived health rules or paradigms in contrast to static decision-making tools. Data to facilitate the health diagnosis also may be obtained from sensors designed for other tools and for different purposes. For example, data from measurement-while-drilling sensors, e.g. current/voltage sensors, pressure transducers, and other types of downhole tool sensors, may be used to acquire data pertinent to the health evaluation of the tool. This enables processing of a wide variety of data to provide a comprehensive bill of health related to a specific downhole tool, and this processing may be done in real time prior to retrieval of the tool from downhole. The bill of health or health evaluation may comprise auxiliary information derived from sensors on the tool, sensors external to the tool, and other information provided by a decision model incorporating multiple channels.

The general approach to health evaluation enables a more comprehensive evaluation of a given tool rather than relying on simple status indicators or the crossing of specific thresholds related to tool operation. Use of data from a wide variety of sources provides a more accurate evaluation of whether a given tool can be reused or should be withdrawn from service for disposal or preventative maintenance. The flexibility of the system also enables linkage, in real-time, to a variety of databases with pertinent information on the tool that can be used in appropriate algorithmic engines to predict tool health. In certain drilling operations, a variety of data on the tool itself can be collected by downhole sensors and transmitted uphole to a surface processing system after drilling has stopped. For example, the transmission of data uphole may be during a circulating "bottoms up" procedure immediately prior to pulling the tool and drill string out of hole. This data can be evaluated in conjunction with a variety of cooperating data in real time to provide a health evaluation prior to retrieval of the tool to surface.

In a specific embodiment, the health or state of a downhole tool is evaluated to determine whether the downhole tool has experienced an event or an accumulation of events over time that suggest the tool should not be rerun on a subsequent job, e.g. a subsequent drilling job. The evaluation also may be used to indicate whether the downhole tool should be repaired or replaced. Rather than interrogating the downhole tool after it returns to the surface, thus consuming valuable rig time, the evaluation can be performed prior to the downhole tool reaching the surface. This real-time evaluation can be used to avoid delays in rig operation or to avoid use of a backup tool employed while the original tool is evaluated at the surface. Thus, the evaluation technique enhances the process of assessing the state of a downhole tool by further optimizing the process of gaining the tools status to reduce rig time and to present the tool data to an operator much earlier while the tool is downhole. This provides the operator with more time, as well as a more comprehensive analysis, to make optimum and efficient decisions on tool re-run.

Tool data on the downhole tool as well as corresponding data from other tools in the drill string may be used in the tool evaluation. Additional data from a variety of databases, e.g. tool histories, engineering data, and other data, also may be combined to enhance the tool health evaluation. In downhole applications, drill strings often incorporate measurement-while-drilling systems, logging-while-drilling systems, rotary steerable systems, and other systems which have sensors, such as multi-axis accelerometers, temperature sensors, rpm sensors, flow sensors, inclination sensors, azimuth sensors, oil level sensors, oil contamination sensors, or other sensors. Data from these corresponding sensors provide information on the corresponding tools and/or on the surrounding formation, and that accumulated data may be processed in a manner to help evaluate the health of the downhole tool.

Data from a sensor or sensors on the downhole tool as well as the corresponding data from other downhole tools may be transmitted to a surface processor via a selected telemetry technique, such as mud pulse telemetry, electromagnetic telemetry, or wired drill pipe telemetry. It should be noted, however, that the downhole tool (and/or corresponding tools) also may comprise processing systems for performing some of the data processing downhole to produce control parameters, e.g. health data, which may be telemetered uphole to a surface processing system. In some applications, sensor data from the surface may be sent downhole for processing on the downhole processing system. The surface data may be sent downhole via wired drill pipe or another suitable telemetry technique.

The telemetry rate of mud pulse telemetry and electromagnetic telemetry from downhole to surface often is relatively slow, commonly having rates in the range between one and six bits per second. Because of the slow telemetry rate, the transmission of data may be arranged in a frame of data words. The downhole tool and the surface processing system are then programmed with knowledge of this frame, e.g. order and word length, so that a header may be used to identify the frame followed by a string of data in a predetermined order. This frame technique for transmitting information to the surface can be very efficient and suitable for use with telemetry systems having relatively low data transfer rates.

In some applications, a methodology known as "on demand frames" may be used. The "on demand frames" methodology allows the downhole tool to trigger a change in a telemetry frame based on a tool state or event. This approach can be used to optimize the transfer of certain types of measurement data to the surface. Such frames also can be used to trigger event information that may affect a decision about drilling parameters or the life or health of the downhole tool.

To facilitate tool health evaluation, the downhole tool may comprise a processor system, such as a microprocessor system, having data storage. In this example, the downhole processor system includes a software module, e.g. a "data accumulation and decision system" for processing sensor data and outputting control parameters based on the processed sensor data. For example, the downhole processor system may output health data related to tool parameters, e.g. low oil level operation, accumulated tool shocks during a run, and other parameters. The data accumulation and decision system may be in the form of an algorithmic engine. Events identified by the accumulation and decision system can be used to trigger a frame change for sending information to the surface in real-time the moment an event happens. By moving evaluation of signals pertinent to tool health downhole, specific events of interest may be communicated to the surface rather than the full amount of raw data. The end result is increased bandwidth efficiency, a more careful scrutiny of performance related data, and quicker detection of problems. The monitoring of relevant data in real-time also may reduce subjectivity in decision-making while limiting the amount of data sent to the surface. Additionally, the processing system may store historical data to accumulate a history of data from previous jobs and runs which can then be used in combination with data processed during a current run.

In some applications, a measurement-while-drilling tool may be used for communicating information to the surface, and bandwidth may be allocated from the downhole tool and from other tools in the bottom hole assembly which each run their own decision and accumulation systems. This allows a variety of data to be processed and enables pertinent control parameters, e.g. health data, to be selected and transmitted to the surface so as to provide a surface operator with a more comprehensive health snapshot. In some cases, the control parameters can be gathered upon a request from the surface via downlink, or via event triggers occurring in specific decision and accumulation systems of the downhole tool and the corresponding tools. The downhole tool (or corresponding tools) may then be used to trigger a health event telemetry frame via signaling to the measurement-while-drilling tool. This control parameter aggregation approach at the downhole, bottom hole assembly level enables the surface health record for a specific downhole tool to be augmented with data provided from the downhole tool and corresponding tools in the bottom hole assembly. Thus, if downhole tools have rudimentary environmental sensing capability, these tools can benefit from a more comprehensive health evaluation based on environmental data accumulated from corresponding tools (and related surface database data).

Due to the limited bandwidth of mud pulse telemetry and electromagnetic telemetry systems, downlinking to the subject downhole tool or tools can be used to change the telemetry frame and to send up the various status/health data in a special frame. The control parameters, e.g. health data information, can be transmitted uphole during drilling. However, the transmission is less susceptible to noise if transmitted when drilling is not taking place, e.g. after completion of the drilling. For example, the telemetry system may be used to transmit data to the surface at the end of a run when drilling is completed and the cuttings are circulated to the surface before pulling the downhole tool and drill string out of hole. The circulating at the end of drilling is referred to as circulating "bottoms up" and provides sufficient time for transmission of the downhole tool data and corresponding tool data prior to retrieval of the downhole tool to surface. The transmission of data to the surface can be triggered automatically or by downlinking to the tool or tools from the surface. The triggering causes the downhole tool to send data, e.g. processed health data or raw data, to the surface via a special frame or a series of frames.

If a special frame is used to transmit information to the surface, the special frame may be designed in several forms. For example, a long frame with multiple data words of various lengths may be used to describe, in detail, the state of the tool. In another example, the frame may contain data which is concatenated between frames, thus using several frames to send the data. The frames would be pre-known by the tool and a surface decoding system of the surface processing system and identified by a unique identifier. If a long frame is used, a frame header may be composed of metadata which describes a frame, thereby negating the reason for pre-knowledge of the frame by the downhole system and the surface system. In fact, the data can be concatenated across multiple frames for such meta-described frames. The metadata allows for dynamic allocation of bandwidth between information derived by the accumulation and decision system of the downhole processor system and raw data. This facilitates evolution of the evaluation system and selection of information pertinent to the parameters of a given situation.

In evaluating the health of a downhole tool, downhole data, e.g. data from the downhole tool and corresponding data from corresponding tools, can be combined with data obtained from a variety of databases. For example, the downhole tool data and corresponding data may be combined with and/or checked against tool histories or tool engineering data stored on a database, e.g. a surface database, accessed by the surface processing system. However, tool histories and other data also may be stored downhole. The tool health evaluation may be based in part on a variety of other surface data, not available to the downhole tools, to better assess the health of a given downhole tool or tools. In some applications, data from a global/local asset and spares management system also can be used in the tool health evaluation to facilitate, for example, scheduling of maintenance and ordering of spare components before the downhole tool is retrieved to the surface. This comprehensive health evaluation of the tool allows the processing system to determine whether to dispatch a replacement tool or to allow the downhole tool to stay at its current location. Similarly, the comprehensive health evaluation can be used to determine whether the downhole tool is sufficiently healthy for use in a subsequent job or whether repair or replacement of the tool is desirable.

Depending on the overall downhole system and application parameters, downlinks may be controlled by an operator or performed automatically by, for example, an automation process system controlling rig operation. In some applications, such downlinks also may be triggered remotely by a centralized monitoring control system. This latter type of system is useful when service company personnel are not actually at the well site. Real-time influx of tool health and environmental data combined with tool related data from a variety of surface databases enables a centralized analysis on a surface processing system to ensure tool reliability and availability.

Referring generally to FIG. 1, an example of a well system 20, e.g. a drilling system, is illustrated as deployed in a borehole 22, e.g. a wellbore. In this example, the well system 20 comprises a drill string 24 having a bottom hole assembly 26. The drill string 24 extends down into a borehole 22 from surface equipment 28, such as a drilling rig. The drill string 24 is designed to drill borehole 22 by rotating a drill bit 30 via a variety of techniques, such as rotating the drill bit via a downhole motive unit, e.g. mud motor or turbine, or rotating the drill bit from the surface via rotating drill pipe.

In the example illustrated, the drill string 24 further comprises a downhole tool 32 which is subject to wear as the tool 32 is used to facilitate the drilling operation. It should be noted that tool 32 may comprise a variety of tools depending on the application. For example, tool 32 may comprise a drilling tool, packer, monitoring equipment, submersible pump, or other well tool. The well system 20 is designed to enable monitoring and evaluation of the health of tool 32 during its current use and in the future from one drilling operation to the next. By way of example, tool 32 may be part of bottom hole assembly 26 and may comprise a steering system, a mud motor, a turbine, a sliding sleeve, a valve system, a sensor system, or a variety of other downhole components. Tool 32 comprises a sensor 34 or a plurality of sensors 34 designed to monitor parameters related to operation of the tool 32. Data from the sensors 34 may be supplied to a downhole processing system 36 which, in the illustrated example, is mounted on or part of tool 32. The downhole processing system 36 comprises storage capability to store data accumulated from sensors 34. In some applications, the downhole processing system 36 is programmed to process data received from sensors 34 so as to provide more pertinent health data which can be transmitted to the surface via a telemetry system 38. By processing data downhole, more relevant data may be transmitted uphole to a surface processing system 40, e.g. a computer-based processing system, as opposed to transmitting the larger amounts of raw data generated by sensors 34. However, some applications may utilize telemetry system 38 to carry sensor data from the surface down to processing system 36 for processing of data downhole. The telemetry system 38 may utilize wired drill pipe or other suitable telemetry techniques for relaying data downhole to the downhole processing system 36.

Additionally, corresponding sensors 42 may be positioned on other downhole tools 44 or at other locations in the downhole environment. Corresponding data from sensors 42 also may be used to help evaluate the health of downhole tool 32 and to provide more comprehensive information as to, for example, the drilling operation and environment in which tool 32 is operated. In some applications, the data from corresponding sensors 42 is provided to the downhole processing system 36 associated with downhole tool 32. However, other embodiments may utilize separate downhole processing systems 36 associated with each of the downhole tools 32 and 44. As discussed above, each downhole processing system 36 may comprise a software module in the form of a data accumulation and decision system for providing control parameters, e.g. health data, related to downhole tool 32, to surface processing system 40.

As discussed above, the telemetry system 38 may comprise a variety of telemetry systems, including mud pulse telemetry systems, electromagnetic telemetry systems, and wired drill pipe telemetry systems. The data from sensors 34, 42 (as processed by the one or more downhole processing systems 36) is telemetered to the surface in appropriate "frames" or according to other suitable transmission protocols via telemetry system 38. Due to limitations on bandwidth with certain telemetry systems 38, the tool health data may be transmitted to the surface at the end of a run when drilling is completed and the cuttings are circulated to the surface before pulling the downhole tool and drill string out of hole. This circulating "bottoms up" period provides sufficient time for transmission of the downhole tool data and corresponding tool data prior to retrieval of the downhole tool to surface. It should be noted that the downhole tool data provided by sensors 34 and the corresponding data provided by sensors 42 may be processed downhole to selected levels of diagnosis via one or more downhole processing systems 36 to reduce data transmitted uphole and to facilitate efficient surface processing on a microprocessor or other suitable processor of processing system 40. Sometimes surface sensor data also may be transmitted down to the one or more downhole processing systems 36.

The processing system 40 may comprise a software module 46, such as an algorithmic engine, designed to receive and process data received from downhole. For example, the software module 46 may be programmed to perform a diagnostic health evaluation of downhole tool 32 based on data received from the sensors 34 directly associated with downhole tool 32 and from other downhole sensors, such as corresponding sensors 42. In some applications, raw data is transmitted to the surface and in other applications the raw data from sensors 34 and 42 is processed downhole via downhole processing system(s) 36 prior to being transmitted uphole via telemetry system 38.

In the present example, processing system 40 is able to perform the diagnostic health evaluation of downhole tool 32 in real time as data is received from downhole via telemetry system 38. However, the processing system 40 also is coupled to other data sources 48, e.g. surface databases, containing data useful in performing a more comprehensive diagnosis of the health of downhole tool 32. By way of example, the data sources 48 may comprise databases at the surface location and/or databases accessible via connection over the Internet or over other communication systems coupled to remote data sources 48. By way of example, the data sources 48 may comprise historical information accumulated from sensors 34 during previous drilling operations, although historical information also may be stored on downhole processing system 36. The data sources 48 may further comprise engineering information related to the tool 32, service records, recall notices, environmental information, and other types of information which may be processed by the algorithmic engine 46 in determining the health tool 32.

The design of well system 20 enables the health evaluation and diagnosis of tool 32 to be completed prior to retrieval of tool 32 so that appropriate actions may be taken before tool 32 reaches the surface. For example, the tool health evaluation may be used to facilitate scheduling of maintenance and ordering of spare components for tool 32 prior to retrieval to the surface. The diagnosis also enables early determination as to whether to dispatch a replacement tool or to allow the downhole tool to stay at its current location. Similarly, the comprehensive health evaluation can be used to determine whether the downhole tool is sufficiently healthy for use in a subsequent job or whether repair or replacement of the tool is desirable. If the tool 32 has an acceptable bill of health, the tool 32 may be used again in, for example, a subsequent drilling job. The diagnosis and determination may be output via surface processing system 40 for use by an operator located at the well site or located remotely with respect to the well site.

Figure 2:
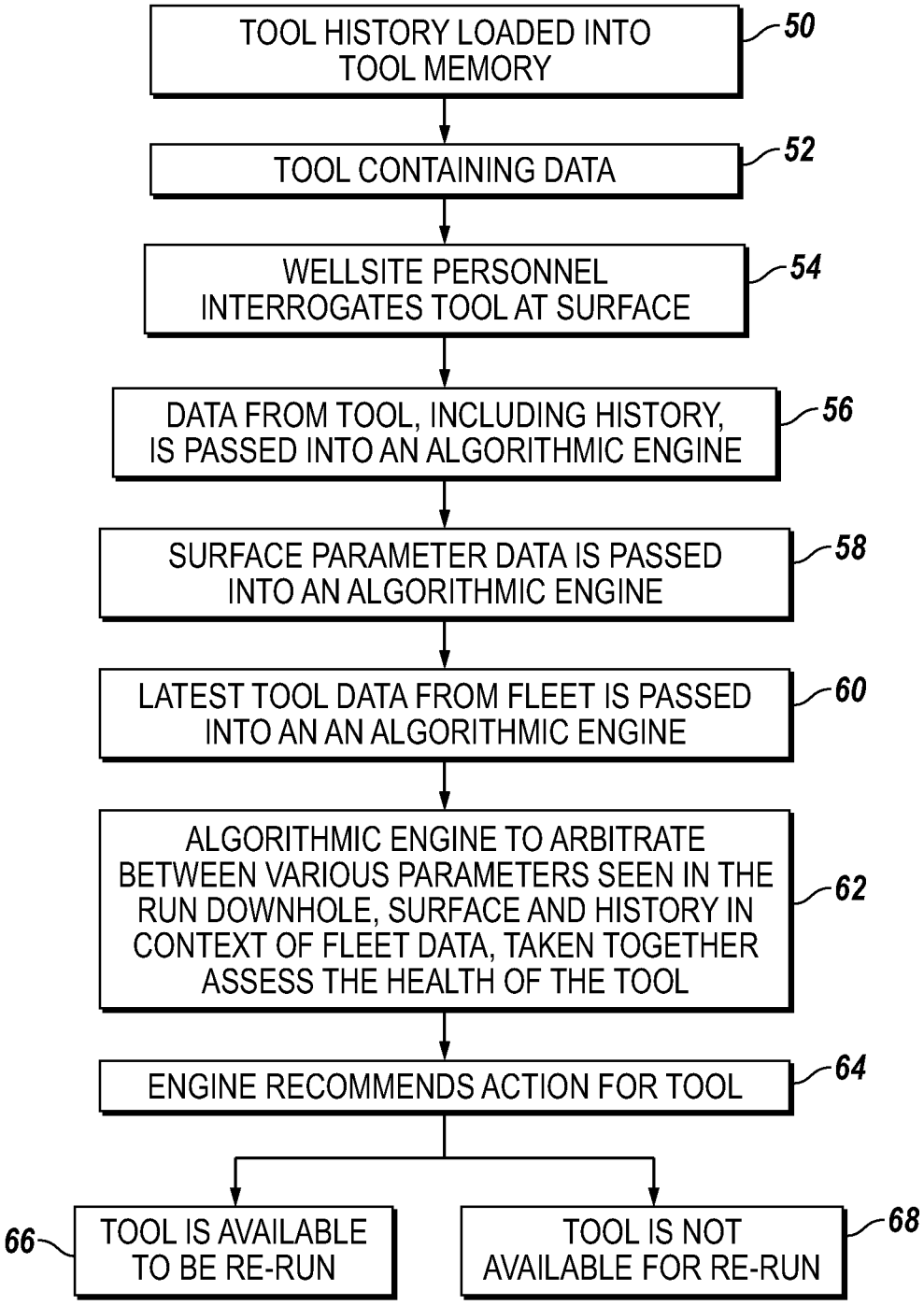
FIG. 2 is a flowchart illustrating an example of a methodology for tool health evaluation, according to an embodiment of the disclosure.

Well system 20 is useful in facilitating a more efficient and comprehensive evaluation of tool health according to a variety of procedures depending on the specifics of the downhole tool 32 and the downhole application. Referring generally to FIG. 2, an example of an operational use of well system 20 is illustrated in flowchart form. In this example, tool history data is initially loaded into the memory of downhole tool 32, e.g. into the memory of the downhole processing system 36 associated with downhole tool 32, as indicated by block 50. The downhole tool 32 is then deployed and operated downhole in borehole 22 and accumulates additional data via sensors 34, as indicated by block 52. The downhole tool 32 may be interrogated by an operator at the surface via, for example, downlinking, as indicated by block 54. The data from downhole tool 32 may then be sent to the surface via telemetry system 38, as discussed in greater detail above.

Data from the downhole tool 32, including the tool history, is then passed into software module 46, e.g. an algorithmic engine, of surface processing system 40, as illustrated by block 56. Related data from corresponding sensors 42 also may be passed into the algorithmic engine. Similarly, other surface obtained data related to tool health also may be passed into the software module 46. For example, surface parameter data may be automatically loaded into software module 46 for processing via the algorithmic engine, as indicated by block 58. Additionally, data from various databases 48, e.g. the latest tool data from a fleet of related tools, may be automatically loaded into the algorithmic engine 46, as indicated by block 60.

The collective data obtained from downhole tool 32, other downhole sensors 42, tool history, surface data obtained from databases 48, and/or other data can then be processed on algorithmic engine 46 of surface processing system 40 to assess the health of downhole tool 32, as indicated by block 62. The processing of downhole data and surface data allows the algorithmic engine 46 to provide a comprehensive diagnosis rather than relying on simple status indicators resulting from the crossing of predetermined thresholds. This enables the algorithmic engine 46 and surface processing system 40 to provide a more accurate diagnosis and recommendation for downhole tool 32, as indicated by block 64. For example, the health evaluation of the downhole tool 32 may lead to a recommendation that the tool 32 is available to be re-run on a subsequent job, as indicated by block 66. If the health of the tool is not sufficient, the surface processing system 40 would recommend that the tool is not available for re-run or is ready for servicing or repair, as indicated by block 68.

Figure 3:
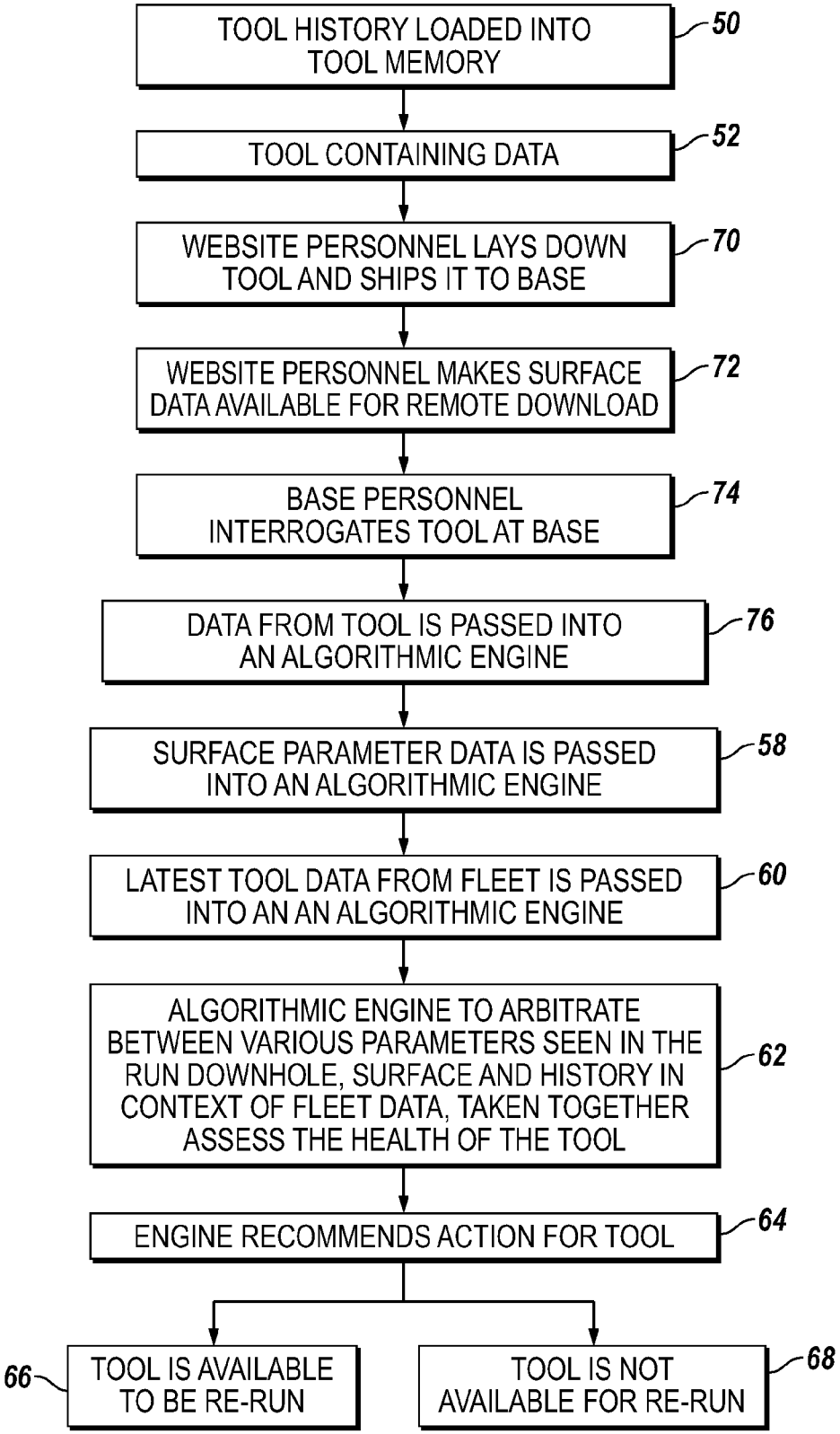
FIG. 3 is a flowchart illustrating another example of a methodology for tool health evaluation, according to an embodiment of the disclosure.

It should be noted that the general process of obtaining a wide variety of data from multiple sources to better evaluate the health of a given tool may be used in many types of applications. For example, the data may be submitted to and processed on processing system 40 regardless of whether the tool has been operated downhole. In the methodology illustrated in FIG. 3, for example, many portions of the procedure are similar to those described with reference to FIG. 2 and common reference numerals have been used to label similar procedural elements. In this latter embodiment, however, well site personnel ship the tool 32 to a base for analysis, as indicated by block 70. Surface data is then made available for remote download into a processing system, such as surface processing system 40, as indicated by block 72. Base personnel who have received the tool 32 at the base are then able to interrogate the tool and obtain data, as indicated by block 74. This data obtained from the tool 32 is passed into the algorithmic engine 46, as indicated by block 76 and combined with a variety of other data for analysis and determination of an appropriate action, as discussed above with reference to FIG. 2.

Figure 4:
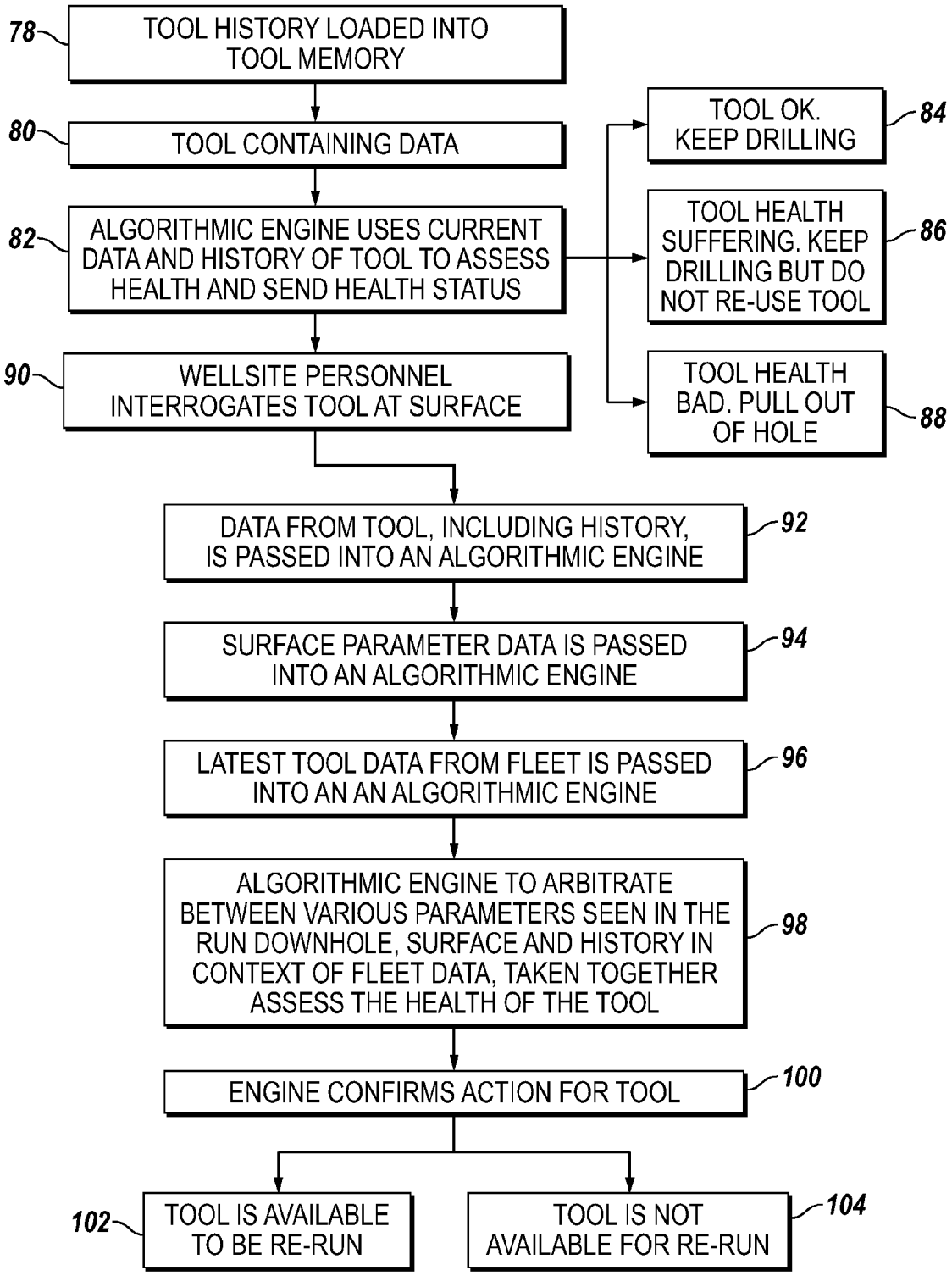
FIG. 4 is a flowchart illustrating another example of a methodology for tool health evaluation, according to an embodiment of the disclosure.

Referring generally to FIG. 4, another example of an operational use of well system 20 is illustrated in flowchart form. In this example, tool history data is again initially loaded into the memory of downhole tool 32, e.g. into the memory of downhole processing system 36 associated with downhole tool 32, as indicated by block 78. The downhole tool 32 is then deployed and operated downhole in borehole 22 and accumulates additional data via sensors 34, as indicated by block 80. During the drilling operation, data from sensors 34 (and possibly corresponding sensors 42) are processed along with data on the tool history via downhole processing system 36 to obtain an initial diagnosis of tool health, as indicated by block 82. Based on this downhole evaluation, a variety of recommendations may be output by the downhole processing system 36. Examples of recommendations include a recommendation to keep drilling, as indicated by block 84, an indication that tool health is suffering but to keep drilling for the time being, as indicated by block 86, or an indication that tool health is bad and the tool 32 should be pulled out of hole, as indicated by block 88.

Additionally, the downhole tool 32 may be interrogated by an operator at the surface via, for example, downlinking, as indicated by block 90. The data from downhole tool 32 may then be sent to the surface via telemetry system 38, as discussed in greater detail above. Data from the downhole tool 32, including the tool history, is then sent to software module 46, e.g. an algorithmic engine, of surface processing system 40, as illustrated by block 92. Related data from corresponding sensors 42 also may be passed into the algorithmic engine. Similarly, other surface obtained data related to tool health also may be passed into the software module 46, as indicated by block 94. For example, data from various databases 48, e.g. the latest tool data from the fleet of related tools, may be passed into the algorithmic engine 46, as indicated by block 96.

The various data obtained from downhole tool 32, other downhole sensors 42, tool history, surface data obtained from databases 48, and/or other data can then be processed on algorithmic engine 46 of surface processing system 40 to assess the health of downhole tool 32, as indicated by block 98. The collection of downhole data and surface data allows the algorithmic engine 46 to provide the desired comprehensive diagnosis of tool health. This type of comprehensive evaluation enables the algorithmic engine 46 and surface processing system 40 to provide more appropriate recommendations for downhole tool 32, as indicated by block 100. For example, the health evaluation of the downhole tool 32 may lead to a recommendation that the tool 32 is available to be re-run on a subsequent job, as indicated by block 102. Or, the surface processing system 40 may recommend that the tool is not available for re-run or is ready for servicing or repair if tool health is found to be insufficient, as indicated by block 104.

Figure 5:
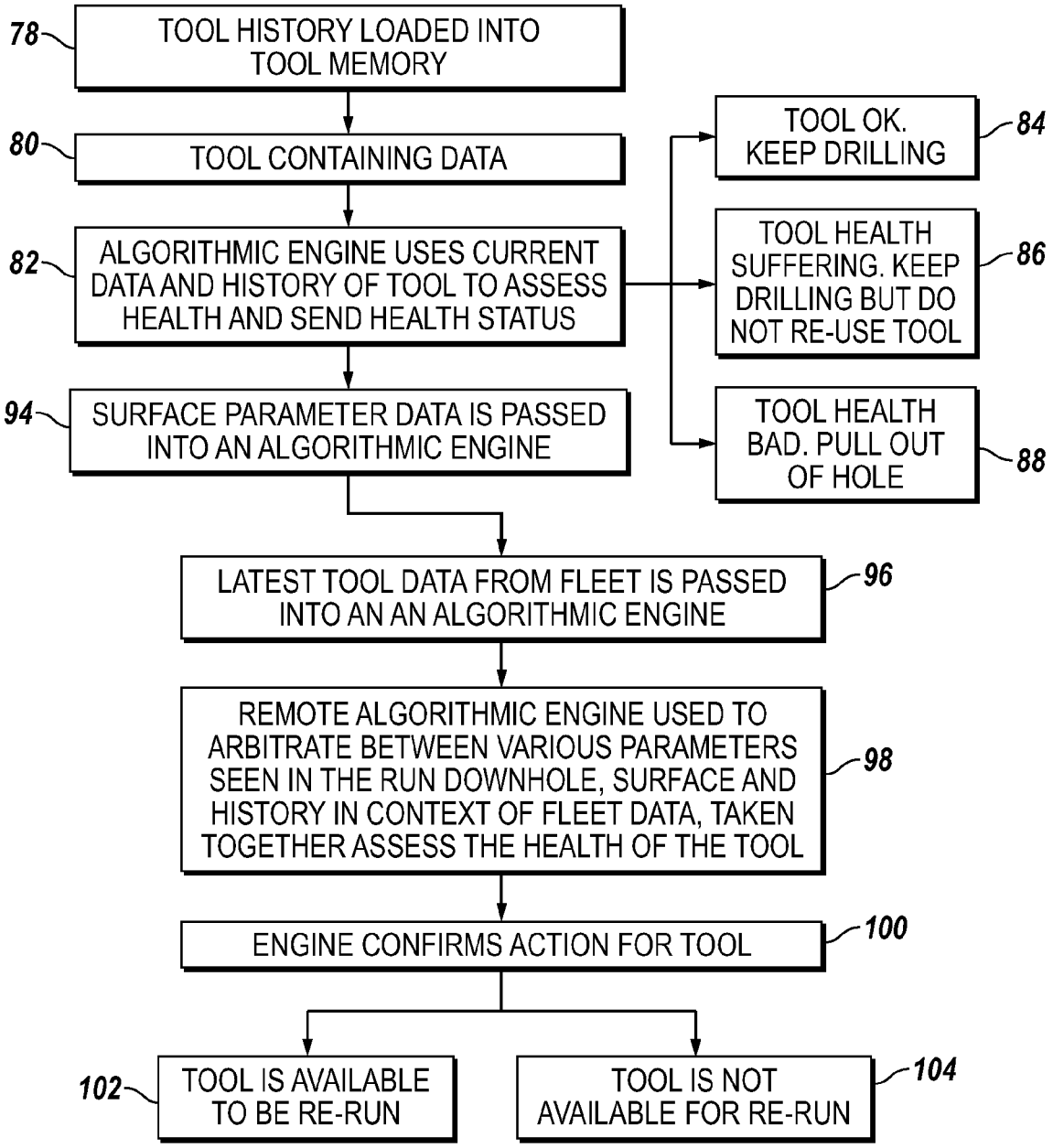
FIG. 5 is a flowchart illustrating another example of a methodology for tool health evaluation, according to an embodiment of the disclosure.

In the methodology illustrated in FIG. 5, many portions of the procedure are similar to those described with reference to FIG. 4 and common reference numerals have been used to label similar procedural elements. In this latter embodiment, however, the downhole tool 32/downhole processing systems 36 are not interrogated by the well site personnel. In this latter example, the algorithmic engine of downhole processing system 36 is again used to provide a preliminary tool health assessment downhole and to then send control parameters, e.g. health data, to the surface. At this stage, the algorithmic engine 46 of surface processing system 40 may be used to analyze the downhole data in combination with a variety of other data, e.g. data from databases 48, to diagnose tool health and to provide suitable recommendations, as described above and as illustrated in both FIGS. 4 and 5.

Figure 6:
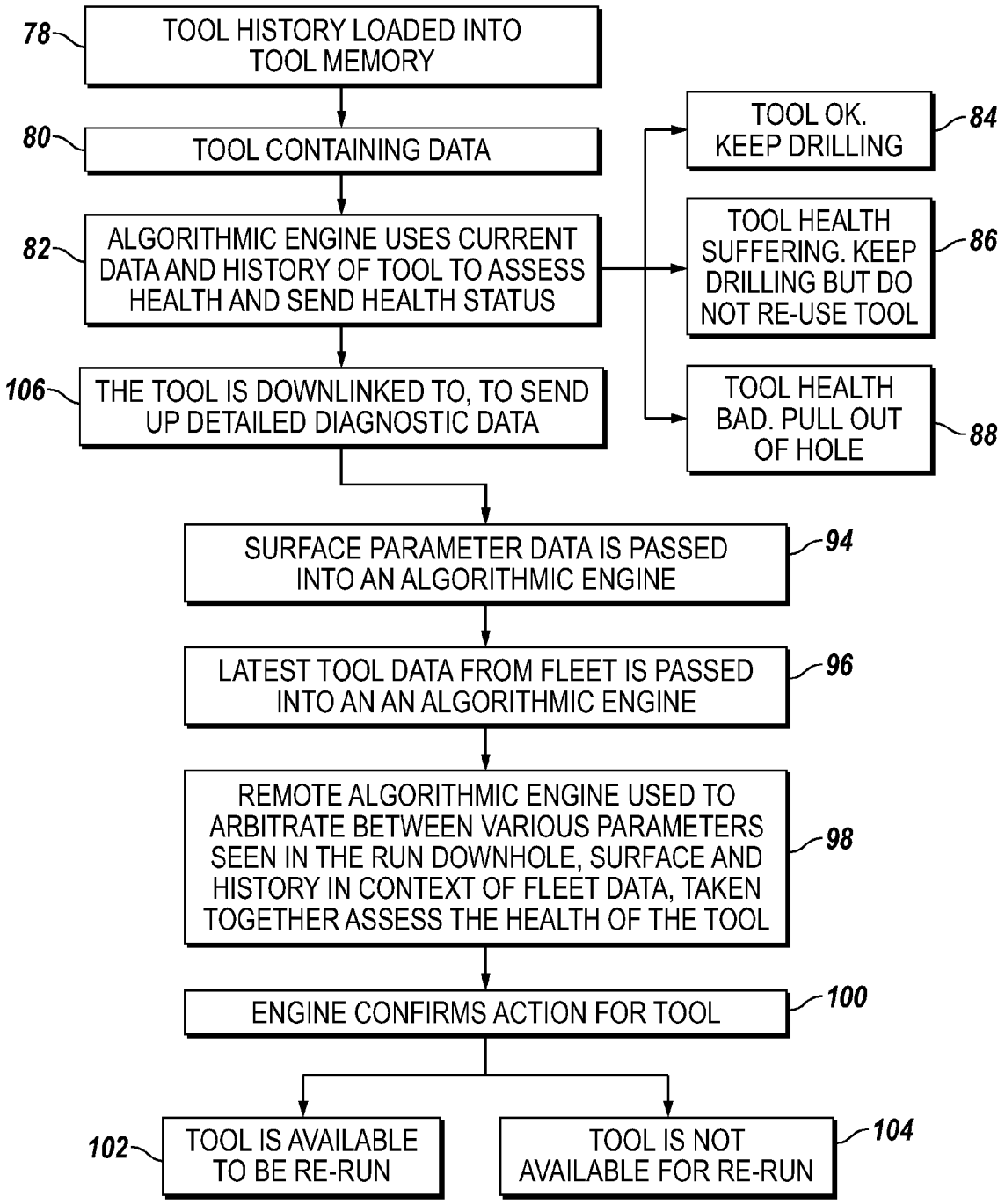
FIG. 6 is a flowchart illustrating another example of a methodology for tool health evaluation, according to an embodiment of the disclosure.

Referring generally to the embodiment of FIG. 6, the tool history of downhole tool 32 is again loaded onto downhole processing system 36, and the downhole processing system 36 is used to analyze data from downhole sensors, e.g. sensors 34 and 42, in combination with the tool history data. The downhole processing system 36 then transmits control parameters, e.g. status/health data, to the surface for further analysis. With respect to the methodology illustrated in FIG. 6, many portions of the procedure are again similar to those described with reference to FIG. 4 and common reference numerals have been used to label similar procedural elements.

In the embodiment illustrated in FIG. 6, a downlink is established from the surface and used as a trigger to initiate transfer of downhole data, as indicated by block 106. The downlink initiates transmission of detailed diagnostic data from the downhole processing system 36. The detailed diagnostic data may comprise data collected from sensors 34 and corresponding sensors 42. Additionally, the data may comprise processed data in the form of control parameters, e.g. health data, which results from processing raw data provided by sensors 34 and/or sensors 42 to downhole processing system 36. In some applications, the detailed diagnostic data may comprise processed tool health data and raw data which may be transmitted uphole via telemetry system 38 during, for example, stoppage of the drilling procedure. As discussed above, a substantial amount of data may be sent to the surface during a circulating "bottoms up" procedure following completion of drilling and prior to retrieval of downhole tool 32 to the surface.

In this latter example, the algorithmic engine of downhole processing system 36 is again used to provide a preliminary tool health assessment downhole and to then send this health data to the surface during, for example, the circulating "bottoms up" stage. The algorithmic engine 46 of surface processing system 40 may be used to analyze the downhole data in combination with a variety of other data, e.g. data from databases 48, in real time as the downhole data is transmitted to surface processing system 40. The comprehensive, collected data from downhole and surface locations is processed according to a suitable algorithm or other model to diagnose tool health and provide suitable recommendations, as described above and as illustrated in both FIGS. 4 and 6.

Figure 7:
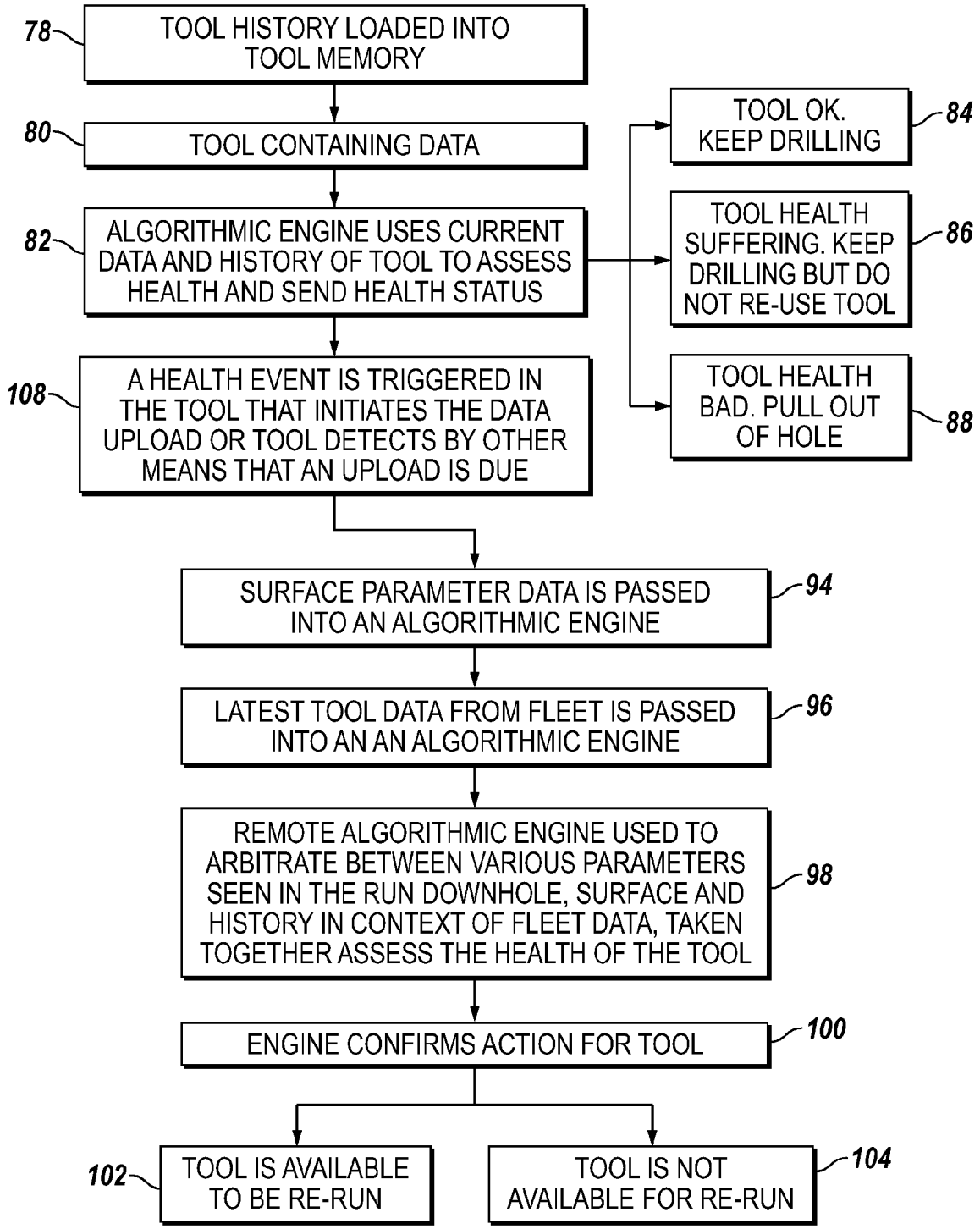
FIG. 7 is a flowchart illustrating another example of a methodology for tool health evaluation, according to an embodiment of the disclosure.

As illustrated in the embodiment of FIG. 7, the transmission of downhole data to the surface may be triggered by mechanisms other than the downlink 106 described with reference to FIG. 6. For example, a specific event which occurs downhole may trigger transmission of the downhole tool control parameters to surface processing system 40, as indicated by block 108. In some applications, the triggering event may be an event which detrimentally affects the health of downhole tool 32 or the health of cooperating tools 44. Upon this triggering event, the downhole data is uploaded to the surface for evaluation by algorithmic engine 46 in combination with other collected data, such as data from databases 48. It should be noted that many portions of the procedure illustrated in FIG. 7 are similar to those described with reference to FIGS. 4 and 6 and common reference numerals have been used to label similar procedural elements.

Figure 8:
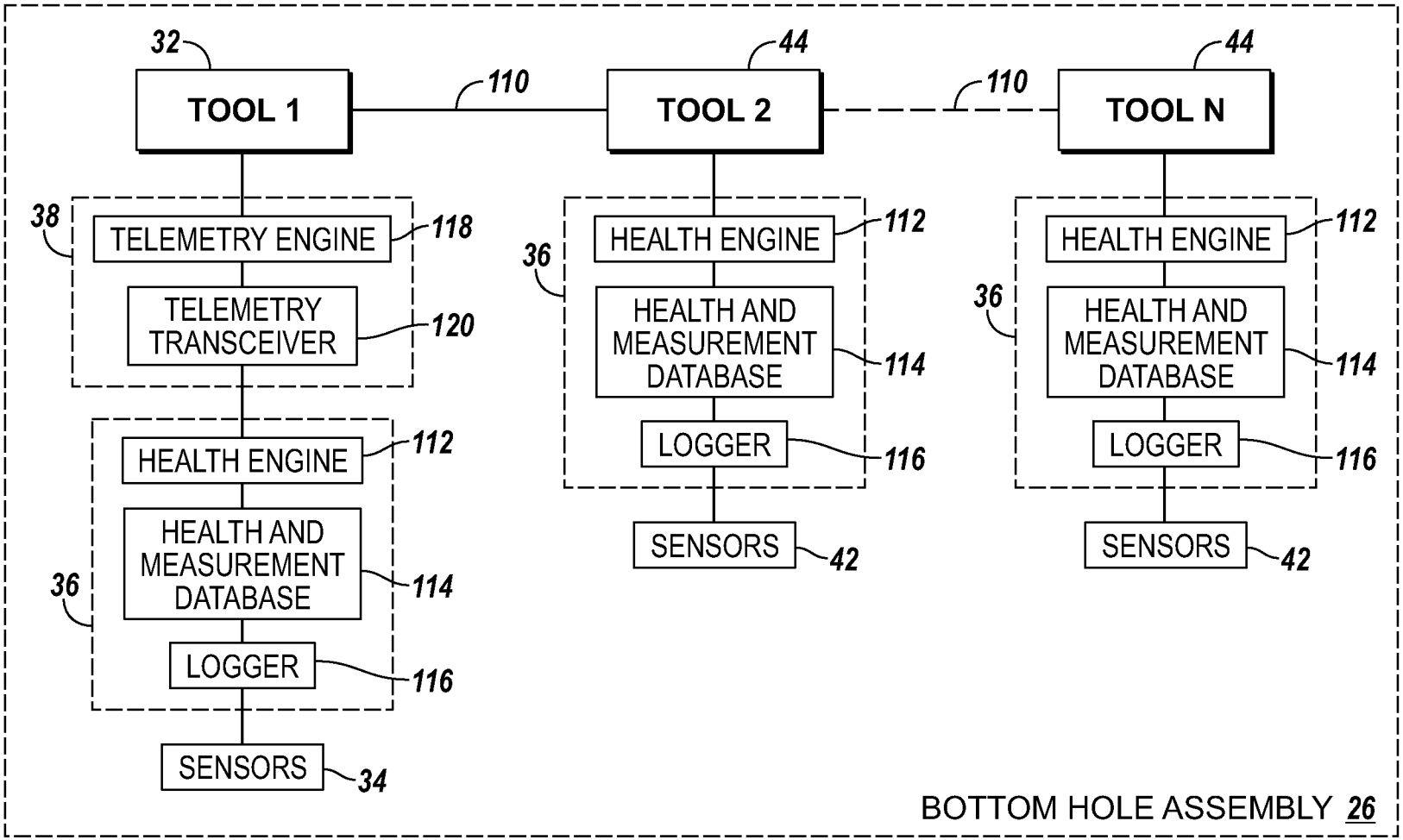
FIG. 8 is a schematic illustration of an embodiment of the well system having a plurality of different tools, according to an embodiment of the disclosure.

The architecture of the downhole system as well as the surface system may vary depending on the goals of a given application, environmental parameters, and/or operational parameters. According to an embodiment, the downhole system may be in the form of a distributed system which obtains data from both the downhole tool 32 and other, corresponding tools 44, as illustrated schematically in FIG. 8. In this example, the downhole tool 32 is communicatively coupled with the other tools 44 via an inter-tool bus 110 which enables transfer of data between tools.

For example, downhole tool 32 may comprise downhole processing system 36 which, in this example, has an algorithmic health engine 112 and a health and measurement database 114 for storing data acquired by sensors 34. The downhole processing system 36 also may comprise a logger 116 designed to log acquired data. In this example, downhole tool 32 also comprises or is coupled with telemetry system 38 which has a telemetry engine 118 able to convert data to a suitable form for transmission to the surface via a telemetry transceiver 120. In some applications, each of the additional tools 44 also may comprise a downhole processing system 36 having a separate health engine 112 working in cooperation with its own health and measurement database 114 and logger 116. The downhole processing system 36 associated with each additional tool 44 is designed to log and store raw data received from corresponding sensors 42 and to process that raw data according to a desired algorithm or model.

Figure 9:
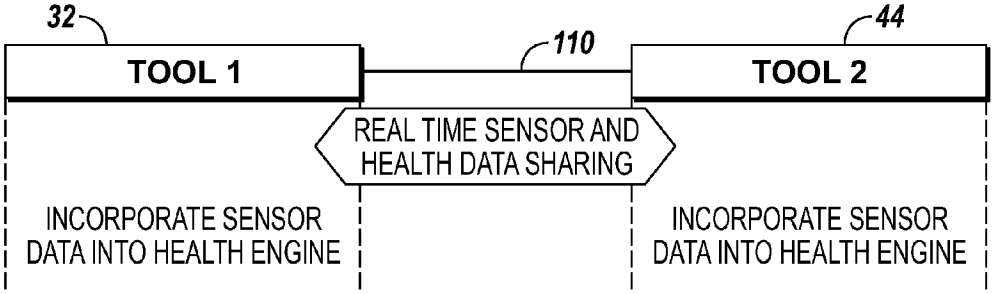
FIG. 9 is a schematic illustration of an embodiment of the well system in which downhole tools collaborate, according to an embodiment of the disclosure.

The data processed by tools 44 may be shared with the downhole processing system 36 associated with downhole tool 32 via inter-tool bus 110, as illustrated in FIG. 9. The transfer of data between tools 44 and downhole tool 32 may be conducted over inter-tool bus 110 in real time. In some applications, the data received from the health engines 112 associated with the other tools 44 may be further processed on the downhole processing system 36 of downhole tool 32.

Figure 10:
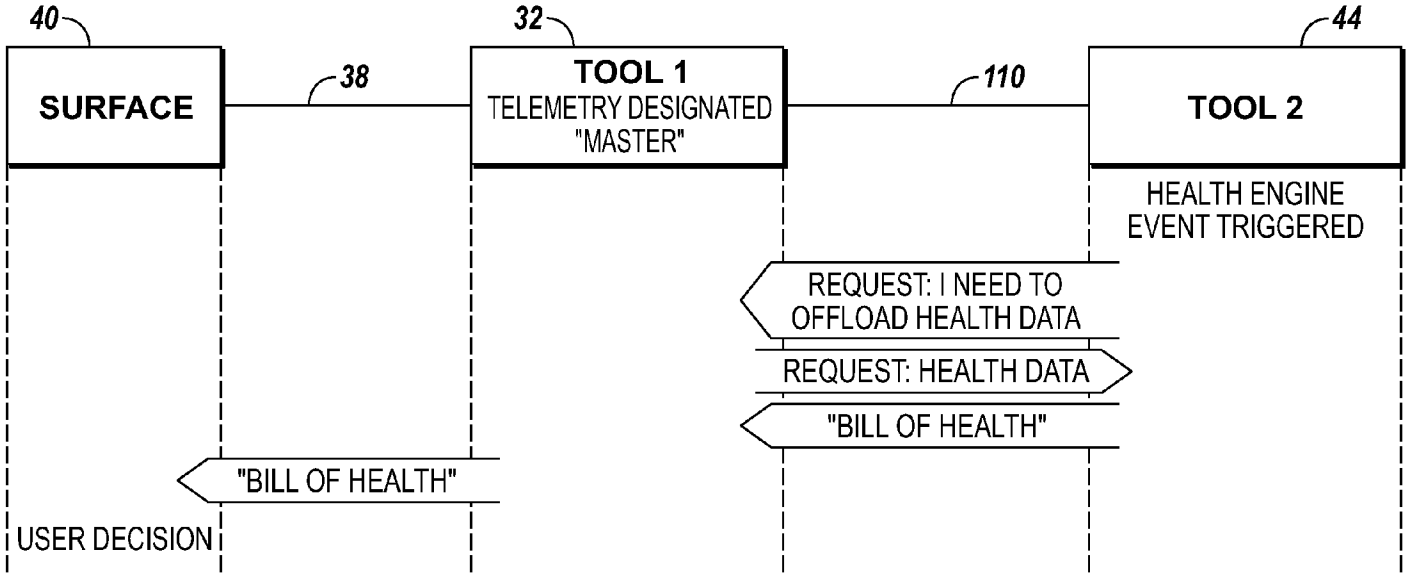
FIG. 10 is a schematic illustration of an embodiment of the well system in which downhole tools collaborate with a surface system, according to an embodiment of the disclosure.

As illustrated in FIG. 10, the downhole processing system 36 of downhole tool 32 may be used to request control parameters, e.g. health data, from the downhole processing systems associated with the other tools 44. Similarly, the tools 44 may be designed to request offloading of health data to the downhole processing system 36 of downhole tool 32 upon the occurrence of specific events. Sometimes, bill of health data or indicators may be supplied to downhole tool 32 on a periodic basis. The downhole processing system 36 of downhole tool 32 can then be used to process this downhole data, e.g. data acquired from both sensors 34 and sensors 42, to provide health data in the form of a suitable "bill of health".

The bill of health is transmitted uphole to surface processing system 40 immediately or at a designated stage, e.g. after stoppage of drilling. Data embodying the bill of health is transmitted to the surface by telemetry system 38 in suitable frames via, for example, mud pulse telemetry or electromagnetic telemetry. However, other telemetry techniques may be employed. At the surface, algorithmic engine 46 of processing system 40 is then used to combine the downhole data with a variety of surface data to provide a comprehensive evaluation and diagnosis with respect to the health of downhole tool 32 and to provide suitable recommendations, as discussed above.

Figure 11:
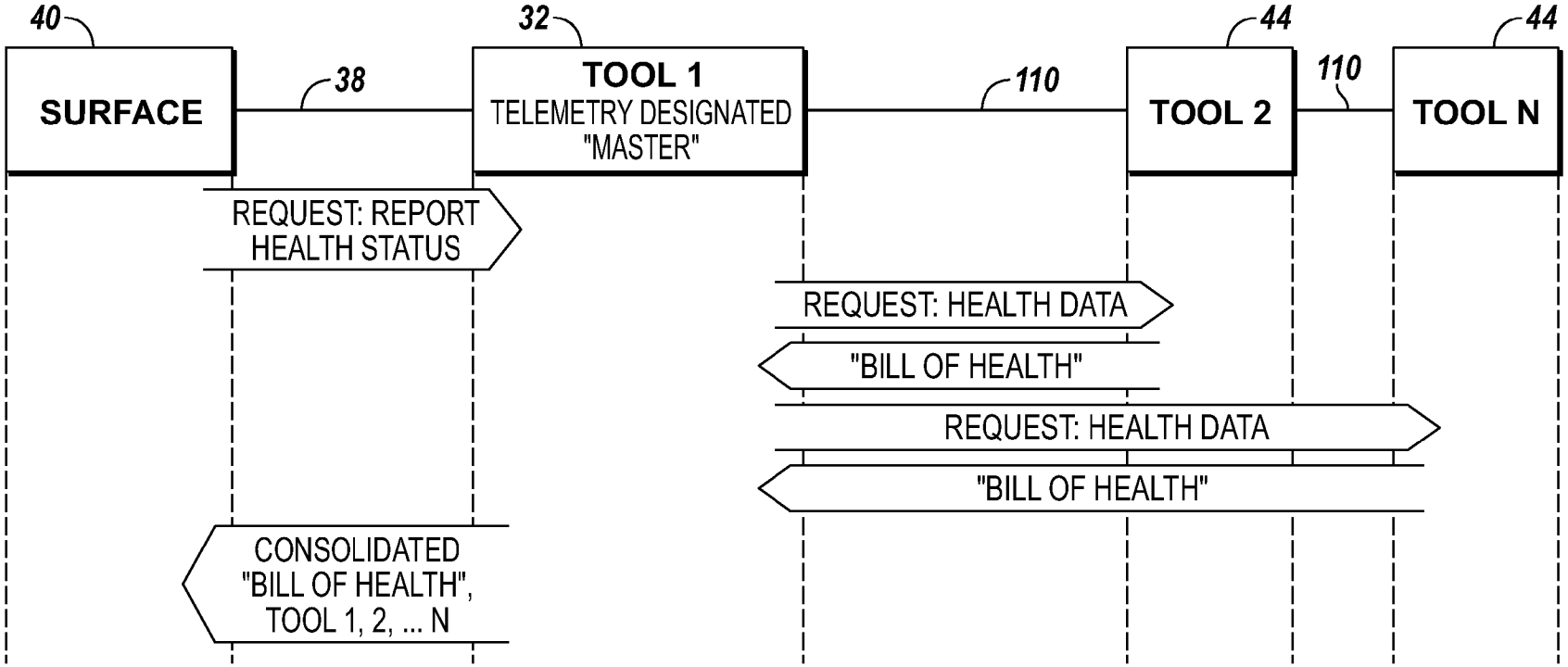
FIG. 11 is a schematic illustration of an embodiment of the well system in which downhole tools of a bottom hole assembly collaborate with each other and with a surface system, according to an embodiment of the disclosure.

Based on the real time interaction of downhole tool 32 and other drill string tools 44, a consolidated bill of health may be constructed downhole based on the available information obtained from downhole sensors 34 and 42, as illustrated in FIG. 11. This consolidated health data can be useful in making determinations regarding the health of tool 32. In many applications, however, the consolidated health data is transmitted to surface processing system 40 for further evaluation with additional data. The transmission of health data to the surface may be initiated in a variety of ways, including automatic downhole triggers or a downlink from the surface, as further illustrated in FIG. 11. The downlink may be based on a request from the surface triggered automatically or by an operator.

Figure 12:
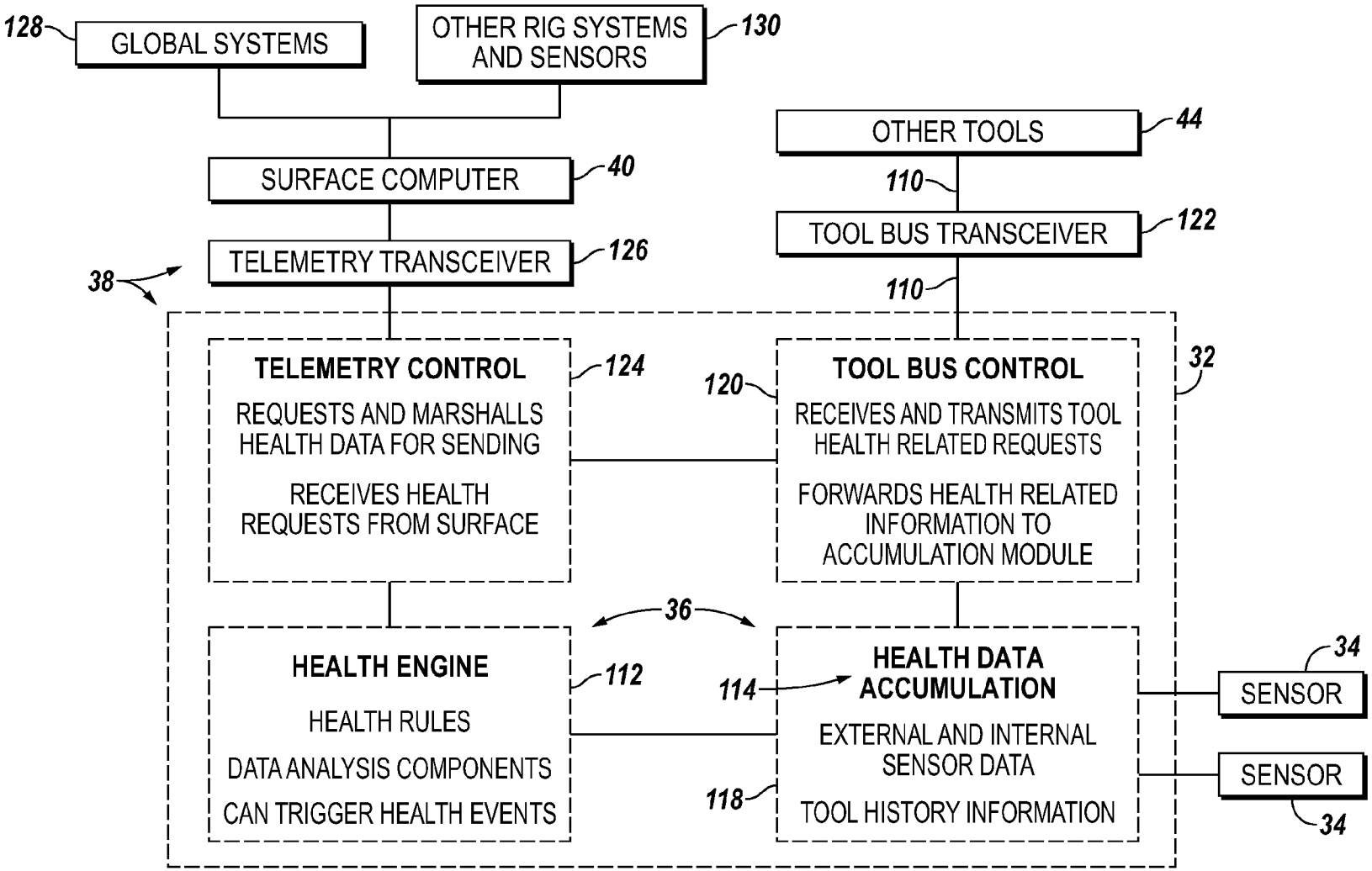
FIG. 12 is a schematic illustration of an embodiment of the well system utilizing data from a variety of sources to establish a health evaluation of a tool, according to an embodiment of the disclosure.

Referring generally to FIG. 12, an example of an overall system for accumulating data and evaluating that data to provide a comprehensive diagnosis with respect to tool health is illustrated. In this example, downhole tool 32 is coupled with sensors 34, receives data from sensors 34, and accumulates the sensor data in a health data accumulation storage 118 which may comprise downhole database 114. The storage 118 may be used to store data from sensors 34, tool history information, data received from other downhole tools/sensors, and/or other downhole data. The health data accumulation storage 118 works in cooperation with health engine 112 which may be in the form of a programmed processor operating according to programmed health rules and data analysis algorithms or models to process and analyze data from storage 118. The health engine 112 also may be used to trigger certain health events, such as transfer of data to the surface in the event of a problem with downhole tool 32.

In this embodiment, downhole tool 32 further comprises a tool bus control 120 which is designed to control the transfer of information between tools/components coupled by inter-tool bus 110. For example, tool health related requests may be received and transmitted between downhole tool 32 and other tools 44 via a tool bus transceiver 122. The tool bus control 120 also may be used to forward health data from other tools 44 and corresponding sensors 42 to the data accumulation storage 118 for processing by algorithmic health engine 112.

As illustrated, downhole tool 32 may further comprise a telemetry control 144 which forms part of telemetry system 38. The telemetry control 124 works in cooperation with a telemetry receiver 126 to receive health requests from the surface and to relay such requests to the appropriate downhole processing system or systems 36. Additionally, the telemetry control 124 is used to manage the transmission of health data, based on data received from sensors 34 and 42, to the surface processing system 40. This downhole health data may be analyzed as it is received in real time by surface processing system 40 in combination with data related to downhole tool 32 and received from a variety of other sources, e.g. databases 48.

For example, the surface processing system 40 may process the downhole data along with data received from remote, global systems 128, e.g. databases 48 containing engineering data, recall data, and other data on downhole tool 32. Additionally, the surface processing system 40 may combine numerous other surface sources of data 130, such as data from rig system databases 48 and surface sensors. By consolidating and processing the data from these diverse sources, a comprehensive health evaluation and diagnosis may be made with respect to downhole tool 32. The comprehensive evaluation facilitates a more accurate diagnosis and a more efficient use of the downhole tool 32. As discussed in detail above, the evaluation and diagnosis may be completed prior to retrieval of the downhole tool 32 to the surface, thus providing efficiency of decision-making and an efficient use of rig time.

Depending on the application, the components of the well system may have a variety of sizes, configurations, and arrangements. For example, the well system may comprise a drilling system designed for drilling vertical or deviated wellbores. The drilling system may utilize a variety of drill string components, such as steering components, motive force components for rotating the drill bit, sensing system components, flow control components for controlling flow of drilling fluid, and a variety of other drill string components. Similarly, the types of sensors, sensor arrangements, sensor data processors, downhole telemetry systems, and other tool related data handling devices may vary depending on the specifics of a given application, the design of the well system, and/or environmental factors. The types of data processed and the algorithms or models for processing the data also may vary depending on the parameters and goals of a given application and on the type of downhole tool being evaluated.

For example, the downhole processing system may be programmed to process a variety of sensor data to create control parameters which enable decision-making regarding a given tool. In many applications, the control parameters comprise health data related to tool health but the control parameters also may be related to other types of tool functionality, e.g. steering decisions, tool actuation decisions, or other tool function decisions. Additionally, the methodology is applicable to many types of serviceable components that may go into a wellbore, including drilling tools, packers, monitoring equipment, submersible pumps, and other well devices.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method for evaluating a well tool, comprising:

operating a tool in a drilling operation in a downhole environment;

accumulating tool data on the tool via a sensor located on the tool;

accumulating corresponding data via an additional sensor located downhole;

obtaining additional data related to the tool from a remote location and transmitting the additional data to a surface processor system;

transmitting the tool data and the corresponding data uphole to the surface processor system prior to pulling the tool out of hole, wherein the data is transmitted after completing drilling;

processing the tool data, the corresponding data, and the additional data in real time on the surface processor system as the tool data and the corresponding data is transmitted uphole;

pulling the drilling tool out of the hole after transmitting tool data up hole; and diagnosing whether the tool has sufficient health for use in a subsequent operation, the diagnosis being completed prior to the tool reaching the surface location when pulled out of hole after drilling is complete and based on processing the transmitted data.

2. The method as recited in claim 1, wherein accumulating tool data and accumulating corresponding data comprises accumulating the tool data and the corresponding data with a plurality of sensors and a plurality of corresponding sensors.

3. The method as recited in claim 1, wherein accumulating corresponding data comprises accumulating data from other tools located in a drill string.

4. The method as recited in claim 1, wherein accumulating corresponding data comprises accumulating data on a surrounding formation.

5. The method as recited in 1, wherein obtaining additional data comprises maintaining stored data on the tool acquired from previous jobs utilizing the tool and obtaining engineering data on the tool from a remote, surface database.

6. The method as recited in claim 1, wherein obtaining additional data comprises sending surface sensor data downhole for processing on a downhole processing system.

7. The method as recited in claim 1, wherein transmitting comprises transmitting the tool data and corresponding data uphole after drilling has stopped and during a circulating bottoms up procedure immediately prior to pulling out of hole.

8. The method as recited in claim 1, wherein transmitting comprises transmitting the tool data and the corresponding data uphole via telemetry frames.

9. The method as recited in claim 1, wherein transmitting comprises transmitting the tool data and the corresponding data uphole via mud pulse telemetry.

10. The method as recited in claim 1, wherein transmitting comprises transmitting the tool data and the corresponding data uphole via electromagnetic telemetry.

11. The method as recited in claim 1, wherein transmitting comprises transmitting the tool data and the corresponding data uphole via wired drill pipe telemetry.

12. The method as recited in claim 1, wherein diagnosing comprises determining the tool is ready for a subsequent drilling job; and further comprising using the tool in the subsequent drilling job based on the determination.

13. A system for efficient use of well tools, comprising:

a well string deployed in a wellbore and comprising a tool employed for a drilling operation;

a plurality of sensors obtaining tool data related to the tool and corresponding data related to other equipment in the well string;

a telemetry system to relay the data from the plurality of sensors for processing;

a processing system which receives the tool data and the corresponding data prior to pulling the tool out of hole and after stopping drilling, wherein the processing system processes the tool data and the corresponding data in real time as the tool data and the corresponding data is transmitted up hole; and a plurality of databases having corresponding data related to the tool, the data and the corresponding data being processed on an algorithmic engine of the processor system to determine a health of the tool prior to withdrawal of the tool to the surface to facilitate a diagnosis while the tool is pulled out of the hole and after transmitting the tool data and the corresponding data up hole.

14. The system as recited in claim 13, wherein the tool comprises at least one of a drilling tool, a packer, monitoring equipment, and a submersible pump.

* * * * *